US009446936B2

(12) United States Patent
Kao et al.

(10) Patent No.: US 9,446,936 B2
(45) Date of Patent: Sep. 20, 2016

(54) PNEUMATICALLY OPERATED OPENER DEVICE

(71) Applicants: Wei-Tung Kao, Tainan (TW); Chih-Lin Hsieh, Tainan (TW)

(72) Inventors: Wei-Tung Kao, Tainan (TW); Chih-Lin Hsieh, Tainan (TW)

( * ) Notice: Subject to any disclaimer, the term of this patent is extended or adjusted under 35 U.S.C. 154(b) by 344 days.

(21) Appl. No.: 14/243,932

(22) Filed: Apr. 25, 2014

(65) Prior Publication Data

US 2015/0307339 A1 Oct. 29, 2015

(51) Int. Cl.
*B67B 7/08* (2006.01)

(52) U.S. Cl.
CPC ..... *B67B 7/08* (2013.01)

(58) Field of Classification Search
CPC ..... B67B 7/182; B67B 7/08; B67B 7/04; B67B 7/0441; B67B 3/26
See application file for complete search history.

(56) References Cited

U.S. PATENT DOCUMENTS 5,020,395 A * 6/1991 Mackey ..... B67B 7/08 141/19
6,477,920 B1 * 11/2002 Yang ..... B67B 7/08 141/19
6,502,481 B1 * 1/2003 Lin ..... B67B 7/08 81/3.2
6,622,595 B1 * 9/2003 Federighi ..... B67B 7/08 7/155
7,454,883 B2 * 11/2008 Hoyt ..... B67B 7/08 53/431
9,016,517 B2 * 4/2015 Craft ..... B67D 1/0412 222/23

* cited by examiner

*Primary Examiner* — Robert Scruggs

(74) *Attorney, Agent, or Firm* — Alan D. Kamrath; Kamrath IP Lawfirm, P.A.

(57) ABSTRACT

A pneumatically operated opener device includes a holding unit, an air valve unit, an air injection unit, and a mounting member. The holding unit includes a hollow grip and a high pressure nitrogen bottle. The air valve unit includes a valve seat and a compressed nozzle module. The air injection unit includes a hollow air duct, a hollow push rod, and an air injecting needle. The mounting member has a through hole and a hollow slot, and the hollow push rod of the air injection unit is extended through the through hole of the mounting member. Thus, the cork is pushed upward by the thrust force of nitrogen from the high pressure nitrogen bottle and is detached from the wine bottle smoothly so that the cork will not be broken and will not produce chips during the opening process.

4 Claims, 16 Drawing Sheets

PNEUMATICALLY OPERATED OPENER DEVICE

BACKGROUND OF THE INVENTION

1. Field of the Invention

The present invention relates to an opener and, more particularly, to a pneumatically operated opener device.

2. Description of the Related Art

A conventional opener (or corkscrew) 2 in accordance with the prior art shown in FIGS. 1 and 2 is used to open a wine bottle 1 and comprises a grip portion 20 and a screw portion 21. In operation, the screw portion 21 is rotated and screwed into the cork 10 of the wine bottle 1. Then, the grip portion 20 is pulled upward by the user to pull and remove the cork 10 from the wine bottle 1 so as to open the wine bottle 1. However, when the cork 10 is too weak to withstand the larger force applied by the user, the cork 10 is easily deformed or broken, thereby failing the opener 2. In addition, the cork 10 cannot be reused when it is broken, so that the cork 10 cannot cover the wine bottle 1 again. Further, the cork 10 easily produces chips due to an excessive force during the opening process so that the chips of the cork 10 easily fall into the wine bottle 1.

BRIEF SUMMARY OF THE INVENTION

In accordance with the present invention, there is provided a pneumatically operated opener device comprising a holding unit, an air valve unit, an air injection unit, and a mounting member. The holding unit includes a hollow grip and a high pressure nitrogen bottle mounted in the hollow grip. The air valve unit includes a valve seat and a compressed nozzle module mounted on the valve seat. The air injection unit includes a hollow air duct, a hollow push rod mounted on a lower end of the hollow air duct, and an air injecting needle mounted on a lower end of the hollow push rod. The mounting member is a cylindrical sleeve. The mounting member has an interior provided with a through hole, and the hollow push rod of the air injection unit is extended through the through hole of the mounting member and connected with the hollow air duct. The mounting member has a lower end provided with a hollow slot.

Preferably, the high pressure nitrogen bottle is located outside of the hollow grip.

Preferably, the mounting member is a triangular cylindrical sleeve, a quadrangular cylindrical sleeve or a polygonal sleeve.

Preferably, the pneumatically operated opener device further comprises a gas injection tube connected with the valve seat of the air valve unit.

According to the primary advantage of the present invention, the cork is pushed upward by the thrust force of the nitrogen from the high pressure nitrogen bottle and is detached from the wine bottle smoothly so that the cork will not be deformed or broken and will not produce chips during the opening process to prevent the chips from falling into the wine bottle.

According to another advantage of the present invention, the air injecting needle is received in the hollow slot of the mounting member when not in use to prevent the air injecting needle from injuring or hurting the user unintentionally.

According to a further advantage of the present invention, the nitrogen isolates and prevents the liquid in the wine bottle from touching oxygen in the air so as to enhance the storage life of the wine.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
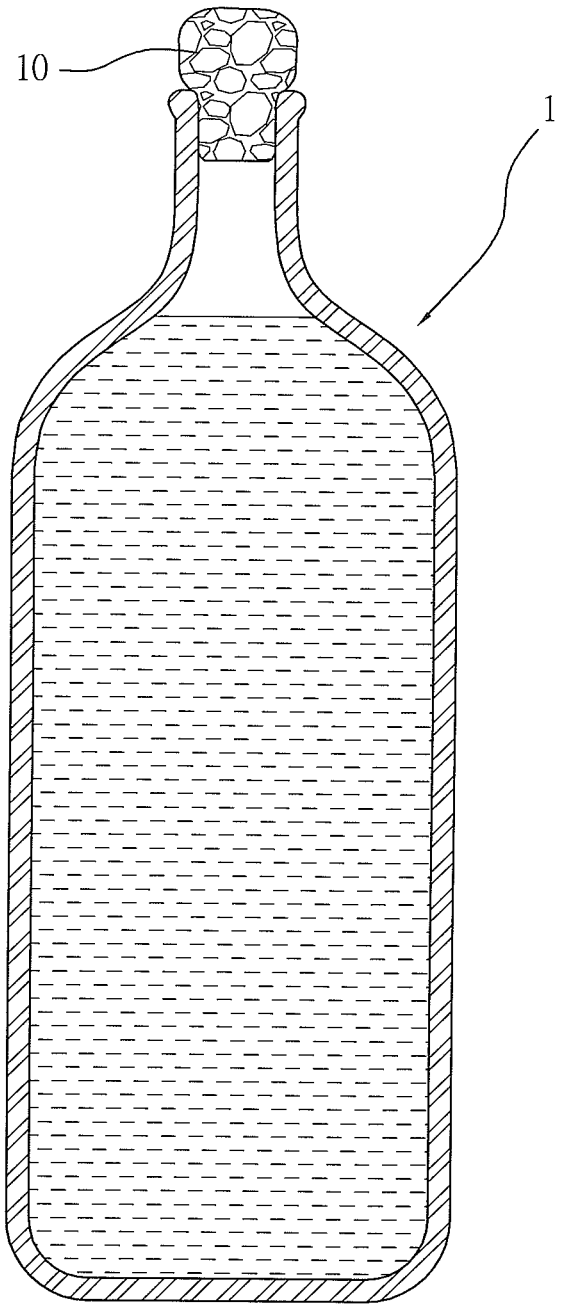
FIG. 1 PRIOR ART
FIG. 1 is a front cross-sectional view of a conventional wine bottle in accordance with the prior art.
Figure 2:
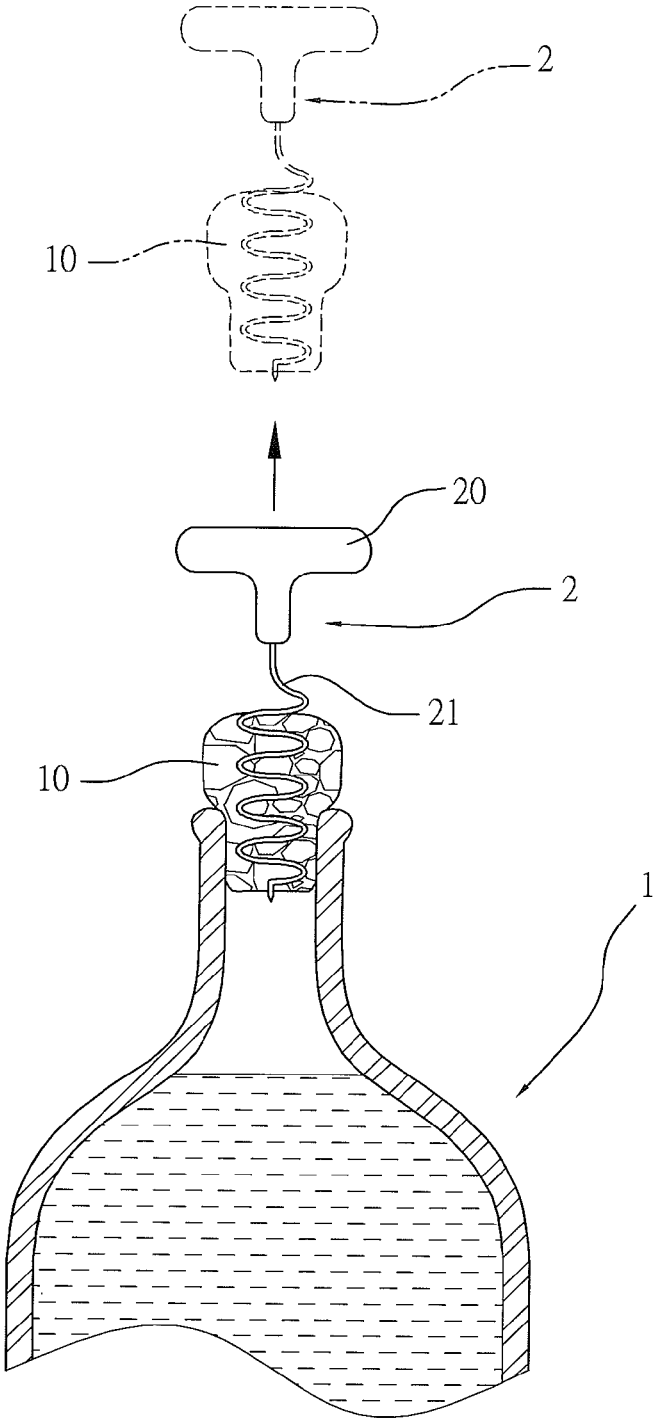
FIG. 2 PRIOR ART
FIG. 2 is a front cross-sectional view of a conventional opener for the wine bottle in accordance with the prior art.
Figure 3:
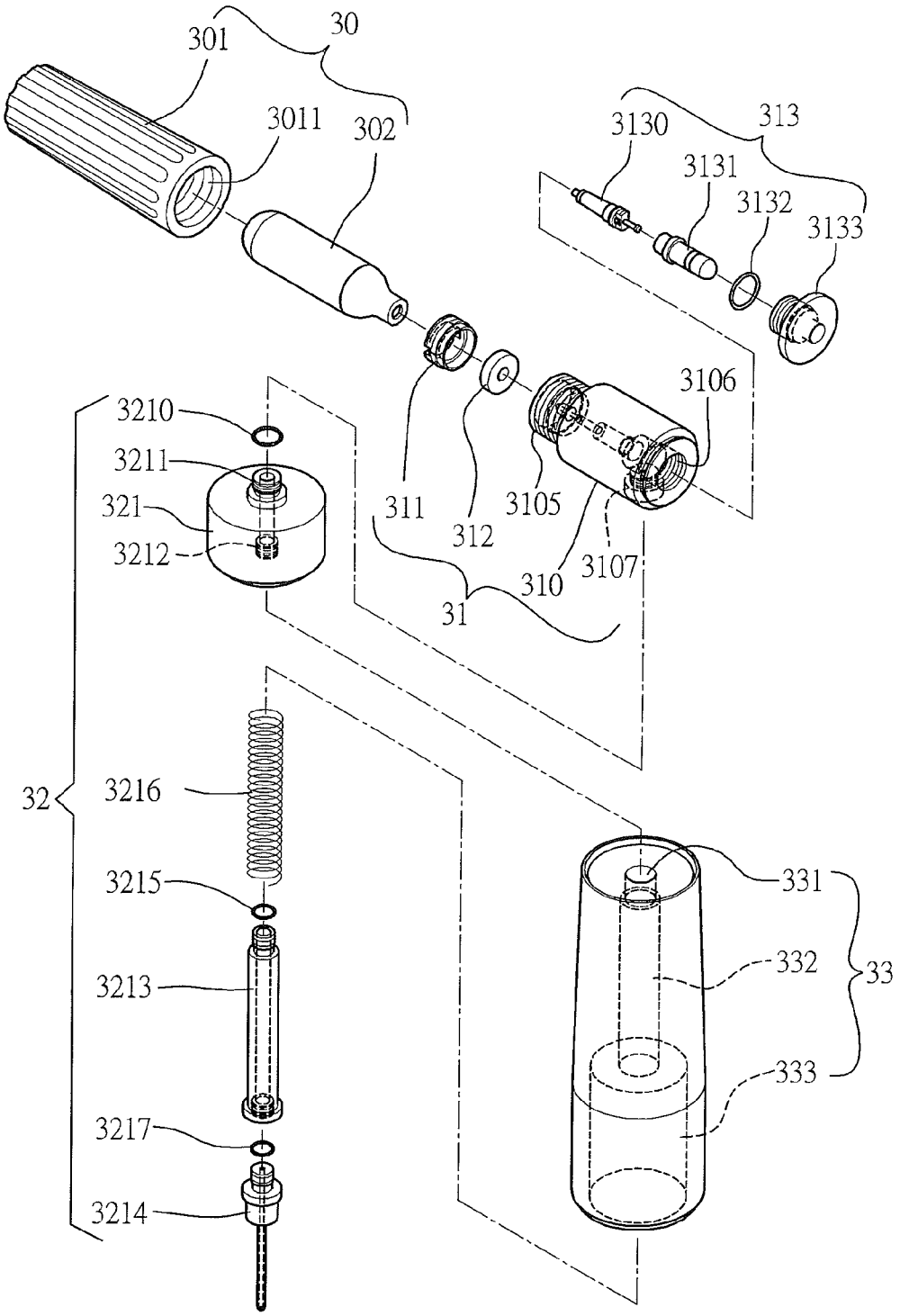
FIG. 3 is an exploded perspective view of a pneumatically operated opener device in accordance with the preferred embodiment of the present invention.
Figure 4:
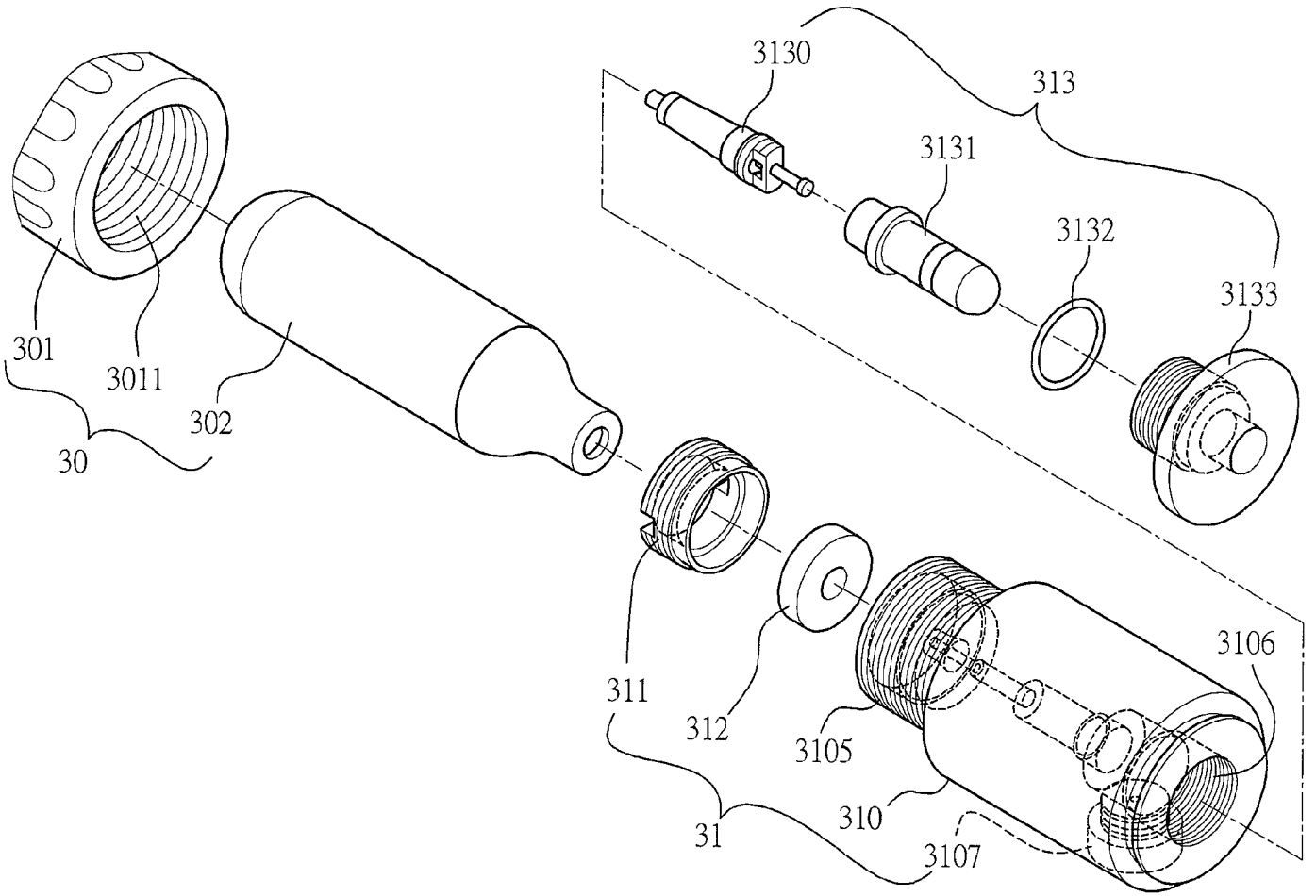
FIG. 4 is a partially exploded perspective view of the pneumatically operated opener device as shown in FIG. 3.
Figure 5:
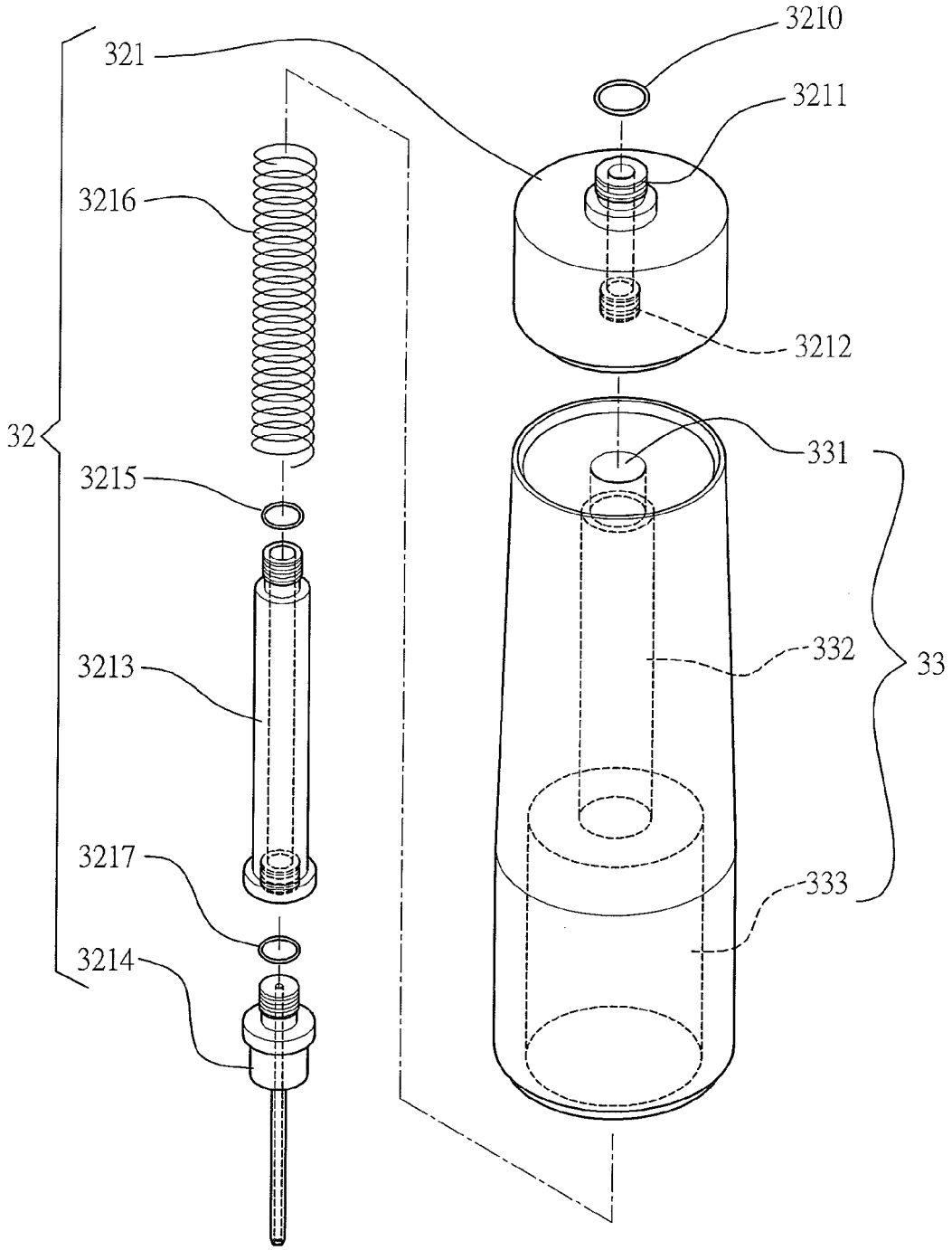
FIG. 5 is a partially exploded perspective view of the pneumatically operated opener device as shown in FIG. 3.
Figure 6:
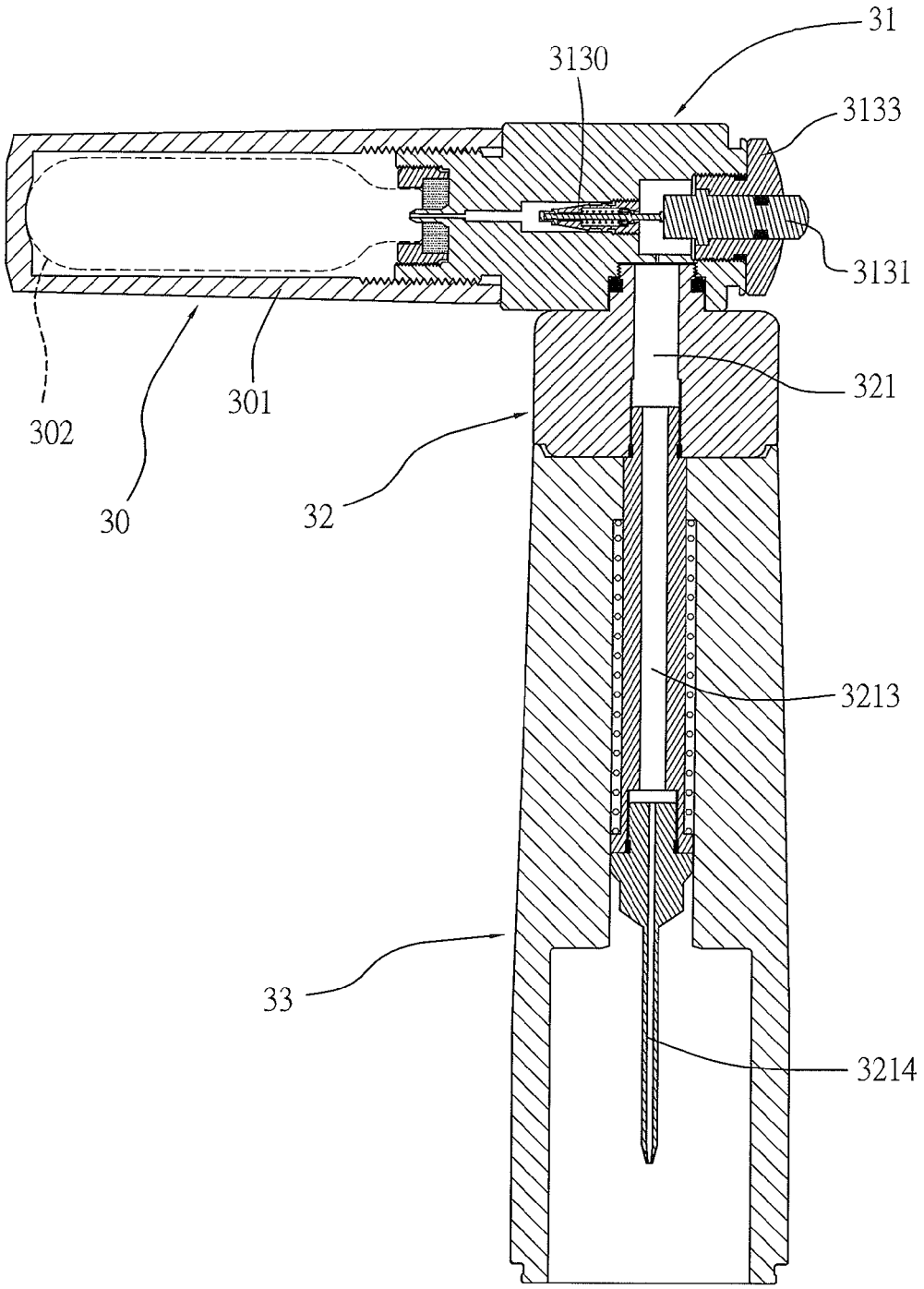
FIG. 6 is a front cross-sectional view of the pneumatically operated opener device as shown in FIG. 3.

Referring to the drawings and initially to FIGS. 3-6, a pneumatically operated opener device in accordance with the preferred embodiment of the present invention comprises a holding unit 30, an air valve unit 31, an air injection unit 32, and a mounting member 33.

The holding unit 30 includes a hollow grip 301, and a high pressure nitrogen bottle 302 mounted in the hollow grip 301. The hollow grip 301 has an end provided with an internal thread 3011 for combining the air valve unit 31.

The air valve unit 31 includes a valve seat 310, a retaining ring 311, a washer 312, and a compressed nozzle module 313. The valve seat 310 has a first end provided with a protruding threaded post 3105. The valve seat 310 has a second end provided with a threaded recess 3106 for mounting the compressed nozzle module 313. The valve seat 310 has a periphery provided with a threaded groove 3107. The compressed nozzle module 313 includes an air inlet nozzle 3130, a thrust rod 3131, an O-ring 3132, and a knob 3133. The knob 3133 has an outer thread that is screwed into the threaded recess 3106 of the valve seat 310. The air inlet nozzle 3130 is connected to an air outlet terminal of the high pressure nitrogen bottle 302. The thrust rod 3131 is movably mounted in the knob 3133 and abuts the air inlet nozzle 3130. The O-ring 3132 is located between the thrust rod 3131 and the knob 3133.

The air injection unit 32 includes a hollow air duct 321, a hollow push rod 3213, a spring 3216, and an air injecting needle 3214. The hollow air duct 321 has an upper end provided with a protruding threaded post 3211 screwed into the threaded groove 3107 of the valve seat 310, and an O-ring 3210 is located between the threaded post 3211 of the hollow air duct 321 and the threaded groove 3107 of the valve seat 310. The hollow air duct 321 has a lower end provided with an inner thread 3212 for screwing a threaded upper end of the hollow push rod 3213, and an O-ring 3215 is located between the hollow push rod 3213 and the inner thread 3212 of the hollow air duct 321. The spring 3216 is mounted on the hollow push rod 3213. The air injecting needle 3214 has a threaded upper end screwed into a threaded lower end of the hollow push rod 3213, and an O-ring 3217 is located between the threaded upper end of the air injecting needle 3214 and the threaded lower end of the hollow push rod 3213.

The mounting member 33 is a cylindrical sleeve and has an upper end provided with a through hole 331 and a passage 332 and a lower end provided with a hollow slot 333. The passage 332 of the mounting member 33 is connected between the through hole 331 and the hollow slot 333. The hollow push rod 3213 of the air injection unit 32 is in turn extended through the passage 332 and the through hole 331 of the mounting member 33 and is then connected with the inner thread 3212 of the hollow air duct 321.

In assembly, again referring to FIGS. 3-6, the air inlet nozzle 3130, the thrust rod 3131, the O-ring 3132 and the knob 3133 are assembled to construct the compressed nozzle module 313. Then, the knob 3133 is screwed into the threaded recess 3106 of the valve seat 310 so that the compressed nozzle module 313 is mounted on the valve seat 310. Then, the retaining ring 311 and the washer 312 are placed into the threaded post 3105 of the valve seat 310, so that the air valve unit 31 is assembled. Then, the air outlet terminal of the high pressure nitrogen bottle 302 is directed toward and connected to the air inlet nozzle 3130, and the internal thread 3011 of the hollow grip 301 is screwed into the threaded post 3105 of the valve seat 310, so that the holding unit 30 is combined with the air valve unit 31. Then, the threaded upper end of the air injecting needle 3214 is screwed into the threaded lower end of the hollow push rod 3213, with the O-ring 3217 being located between the threaded upper end of the air injecting needle 3214 and the threaded lower end of the hollow push rod 3213. Then, the spring 3216 is mounted on the hollow push rod 3213. Then, the hollow push rod 3213 of the air injection unit 32 is in turn extended through the hollow slot 333, the passage 332 and the through hole 331 of the mounting member 33. Then, the threaded upper end of the hollow push rod 3213 is screwed into the inner thread 3212 of the hollow air duct 321 so that the hollow push rod 3213 is connected with the hollow air duct 321. At this time, the O-ring 3215 is located between the hollow push rod 3213 and the inner thread 3212 of the hollow air duct 321, and the spring 3216 is biased between the hollow push rod 3213 and the mounting member 33. In such a manner, the hollow push rod 3213 is driven by the hollow air duct 321 to move relative to the mounting member 33. Thus, the hollow push rod 3213 is movable in the passage 332 and the through hole 331 of the mounting member 33, and the air injecting needle 3214 is movable in the hollow slot 333 of the mounting member 33.

Figure 7:
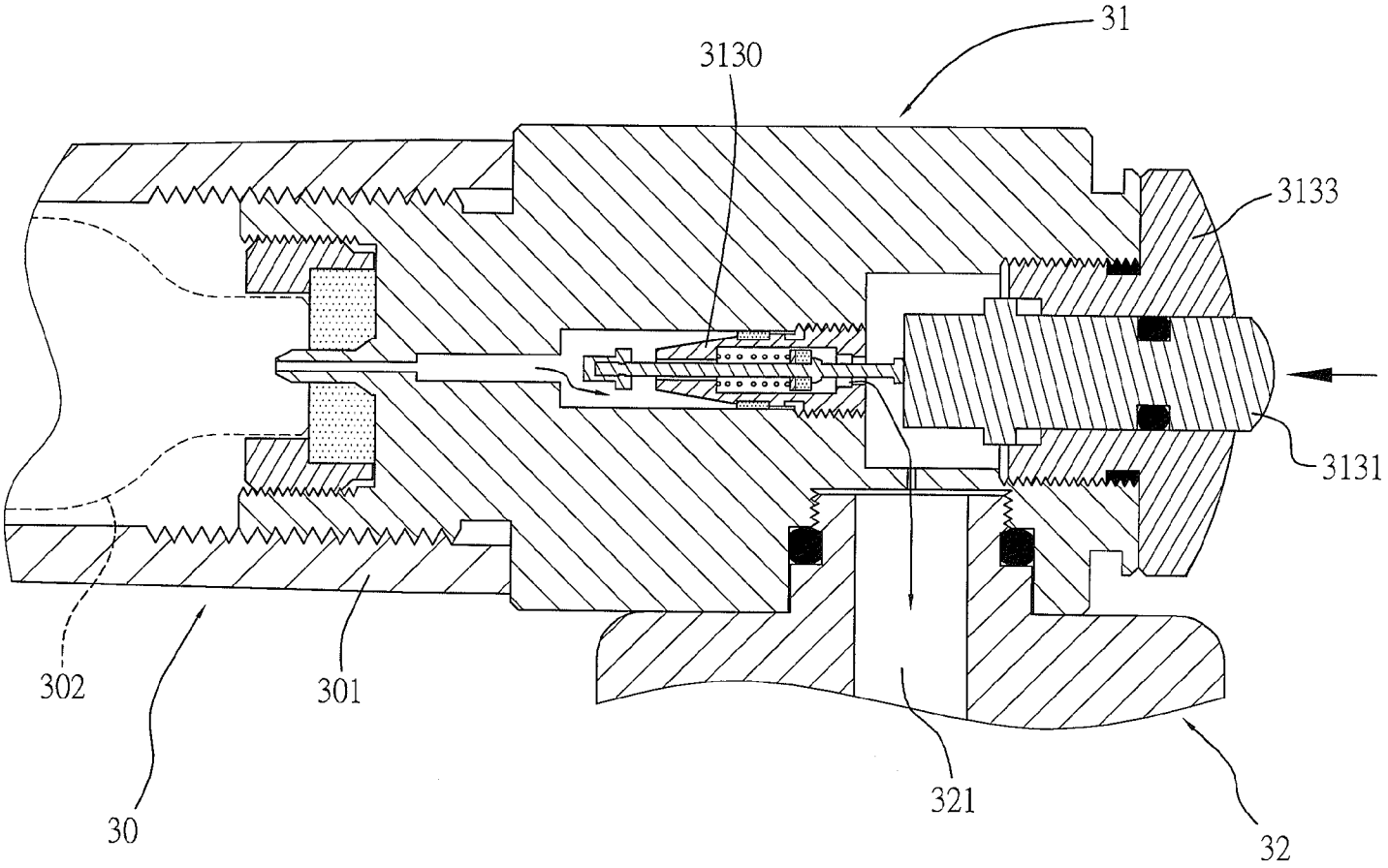
FIG. 7 is a locally enlarged operational view of the pneumatically operated opener device as shown in FIG. 6.

In practice, referring to FIG. 7 with reference to FIGS. 3-6, when the thrust rod 3131 is pressed inward in the knob 3133, the thrust rod 3131 is moved to press the air outlet terminal of the high pressure nitrogen bottle 302 so as to open the high pressure nitrogen bottle 302 so that the nitrogen in the high pressure nitrogen bottle 302 is released and flows through the air inlet nozzle 3130, the hollow air duct 321, the hollow push rod 3213 and the air injecting needle 3214 and is injected outward from the air injecting needle 3214.

Figure 8:
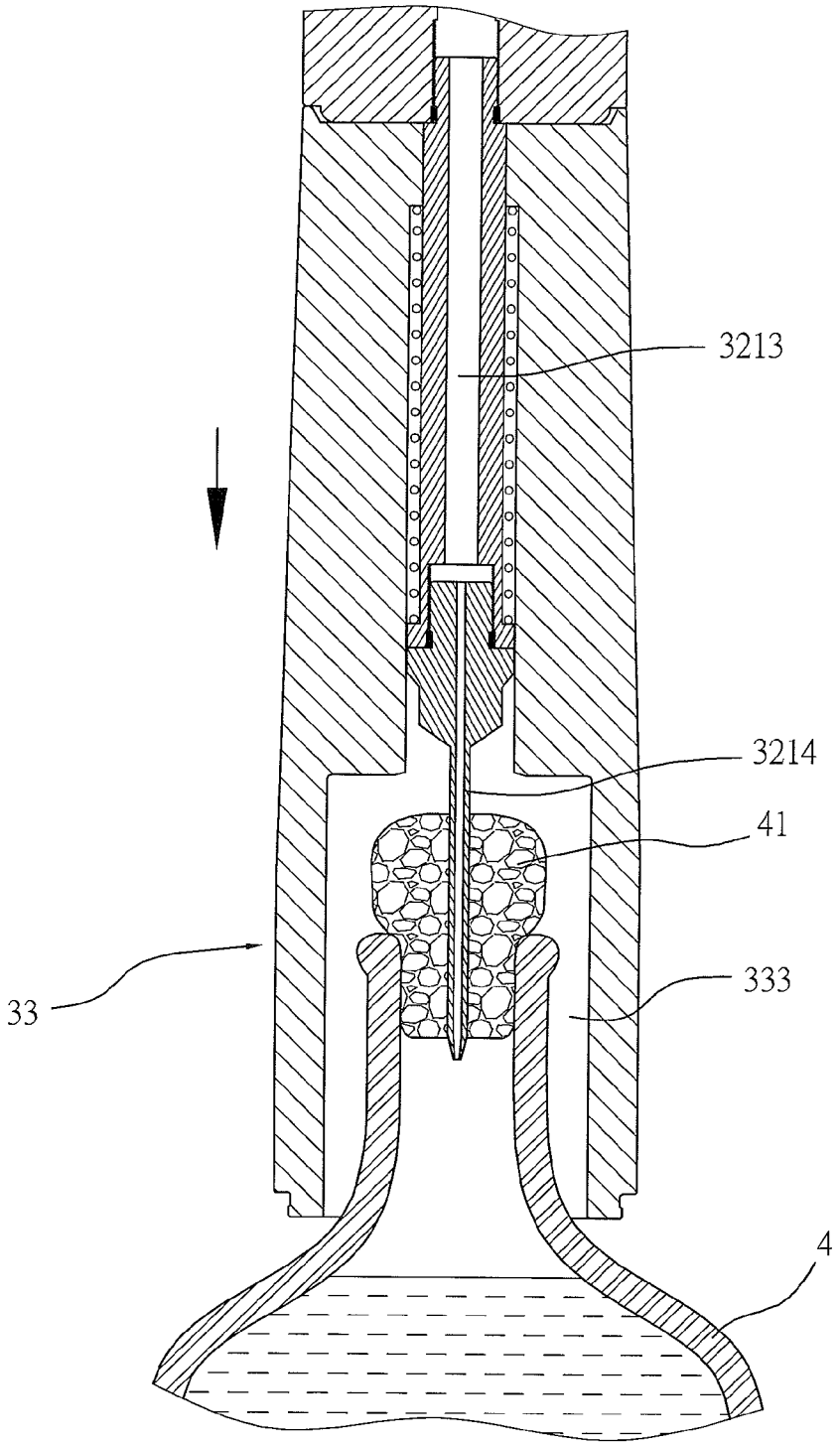
FIG. 8 is a locally enlarged operational view of the pneumatically operated opener device as shown in FIG. 6.
Figure 9:
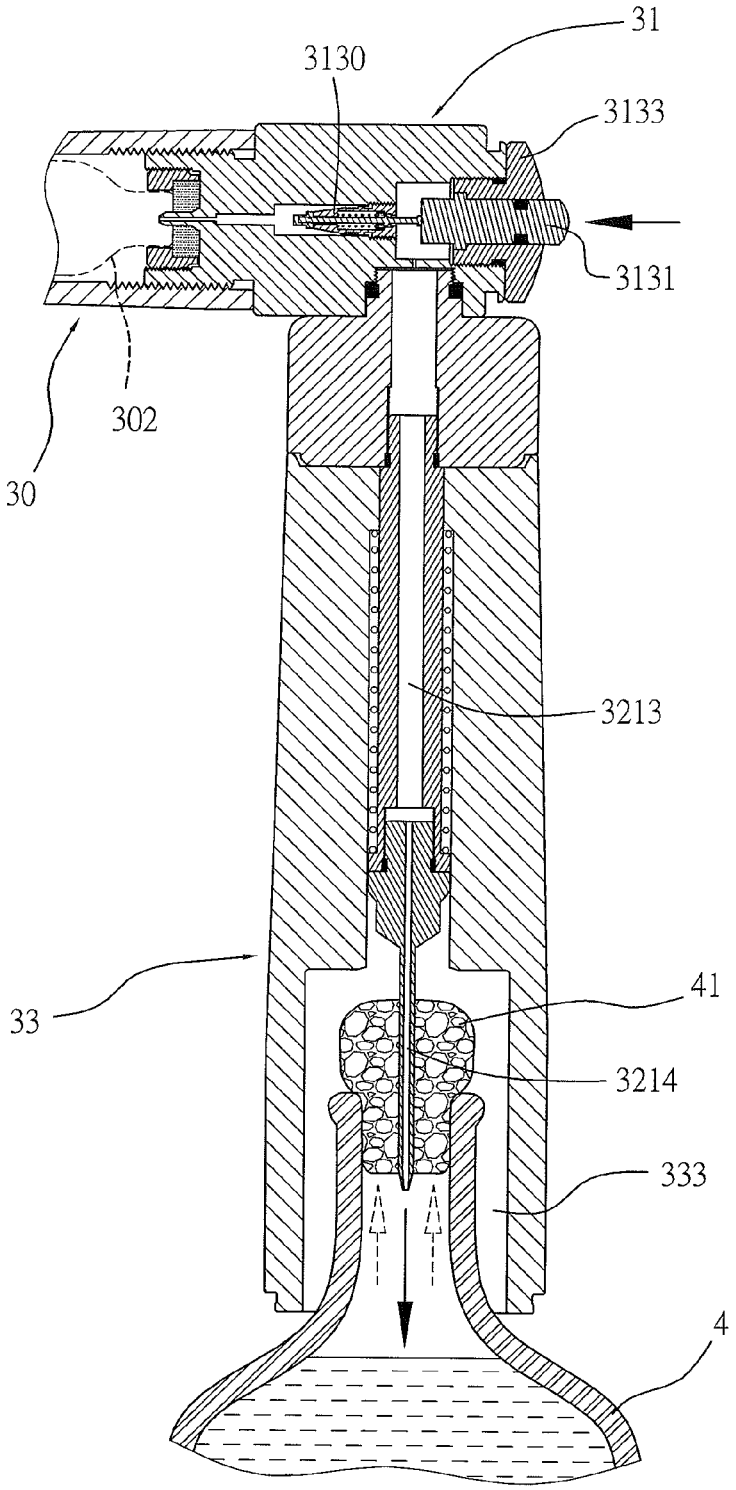
FIG. 9 is a locally enlarged operational view of the pneumatically operated opener device as shown in FIG. 6.
Figure 10:
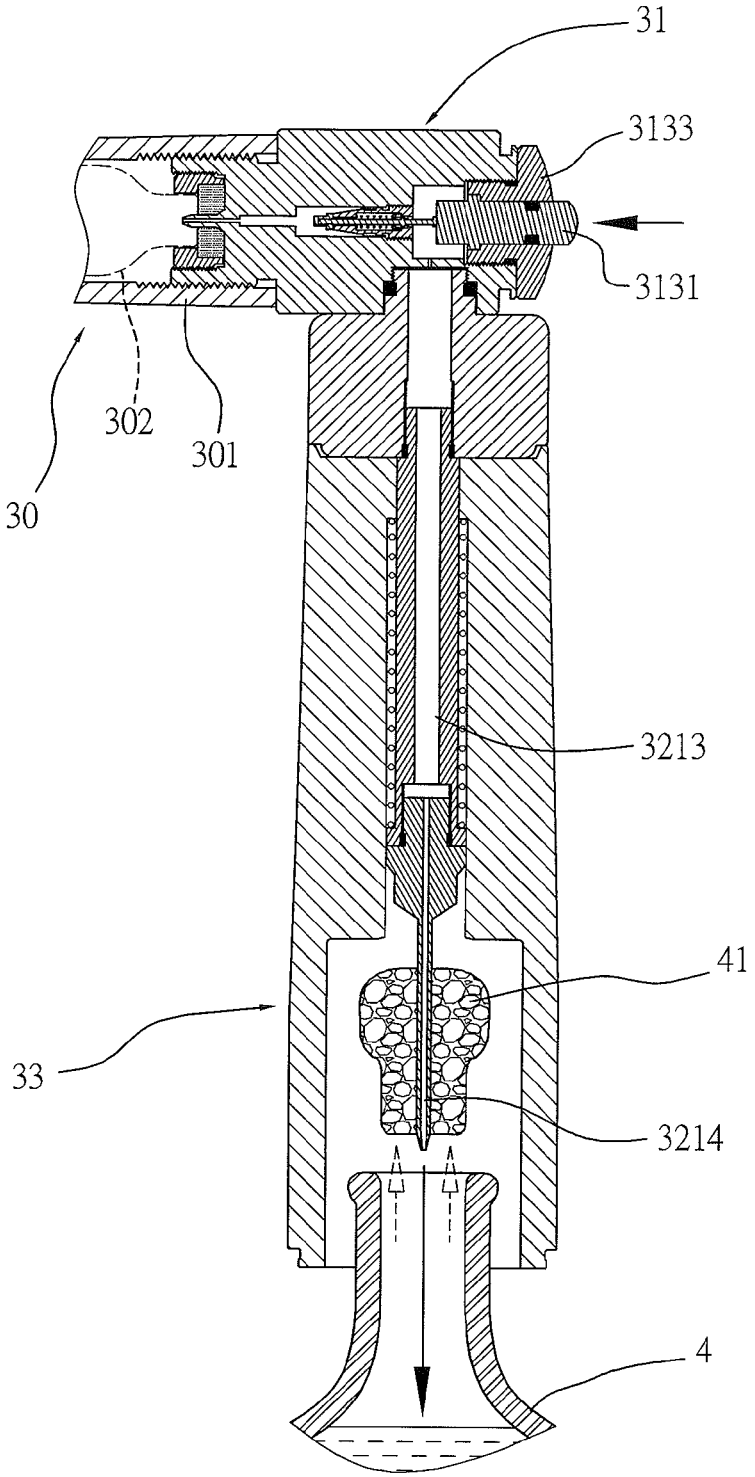
FIG. 10 is a locally enlarged operational view of the pneumatically operated opener device as shown in FIG. 9.
Figure 11:
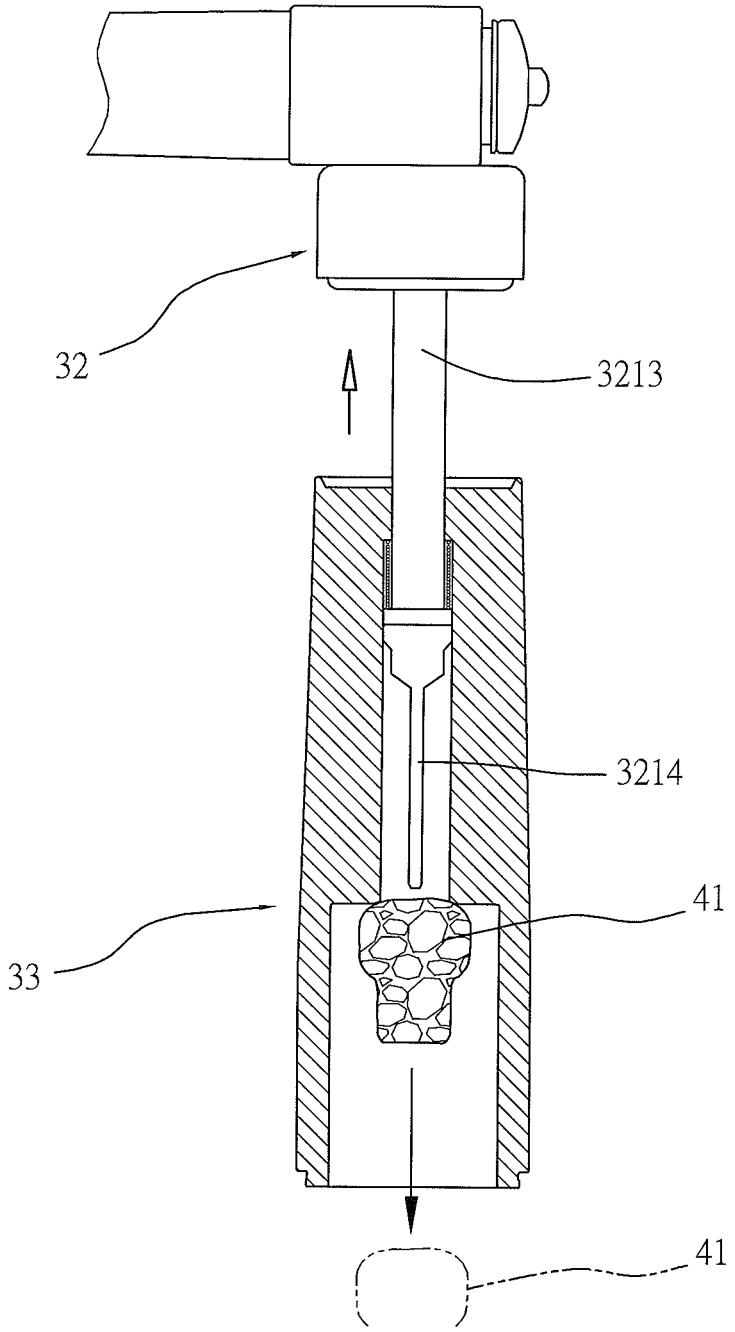
FIG. 11 is a locally enlarged operational view of the pneumatically operated opener device as shown in FIG. 10.

In operation, referring to FIGS. 8-11 with reference to FIGS. 3-6, the hollow slot 333 of the mounting member 33 is mounted on a wine bottle 4. Then, the hollow grip 301 is pulled by the user to move upward relative to the mounting member 33 to move the hollow push rod 3213 and the air injecting needle 3214 upward relative to the mounting member 33. At this time, the spring 3216 is compressed to store a restoring force. After the force applied on the hollow grip 301 disappears, the hollow grip 301 is forced by the restoring force of the spring 3216 to move toward the mounting member 33, while the hollow push rod 3213 and the air injecting needle 3214 are moved downward relative to the mounting member 33, so that the air injecting needle 3214 is lowered to pierce the cork 41 of the wine bottle 4 as shown in FIG. 8. After the air injecting needle 3214 penetrates the cork 41 of the wine bottle 4, the thrust rod 3131 is pressed inward by the user, to drive the air inlet nozzle 3130 which is moved to press the air outlet terminal of the high pressure nitrogen bottle 302 so as to open the high pressure nitrogen bottle 302 so that the nitrogen in the high pressure nitrogen bottle 302 is released and in turn flows through the air inlet nozzle 3130, the hollow air duct 321, the hollow push rod 3213 and the air injecting needle 3214, and is then injected outward from the air injecting needle 3214 into the wine bottle 4 as shown in FIG. 9. After the nitrogen is filled with the wine bottle 4, the nitrogen produces a greater pressure which pushes the cork 41 upward gradually until the cork 41 is detached from the mouth of the wine bottle 4 as shown in FIG. 10 so as to open the wine bottle 4. Then, the mounting member 33 is removed from the wine bottle 4. Then, the hollow grip 301 is pulled upward relative to the mounting member 33 to move the hollow push rod 3213 and the air injecting needle 3214 upward relative to the mounting member 33 so as to move the cork 41 upward. When the cork 41 abuts the top wall of the hollow slot 333, the cork 41 stops moving, while the hollow push rod 3213 and the air injecting needle 3214 keeps moving upward, so that the cork 41 is detached from the air injecting needle 3214 as shown in FIG. 11. In such a manner, the cork 41 is removed from the mounting member 33 easily and quickly and will not be deformed or broken so as to maintain the shape of the cork 41.

Figure 12:
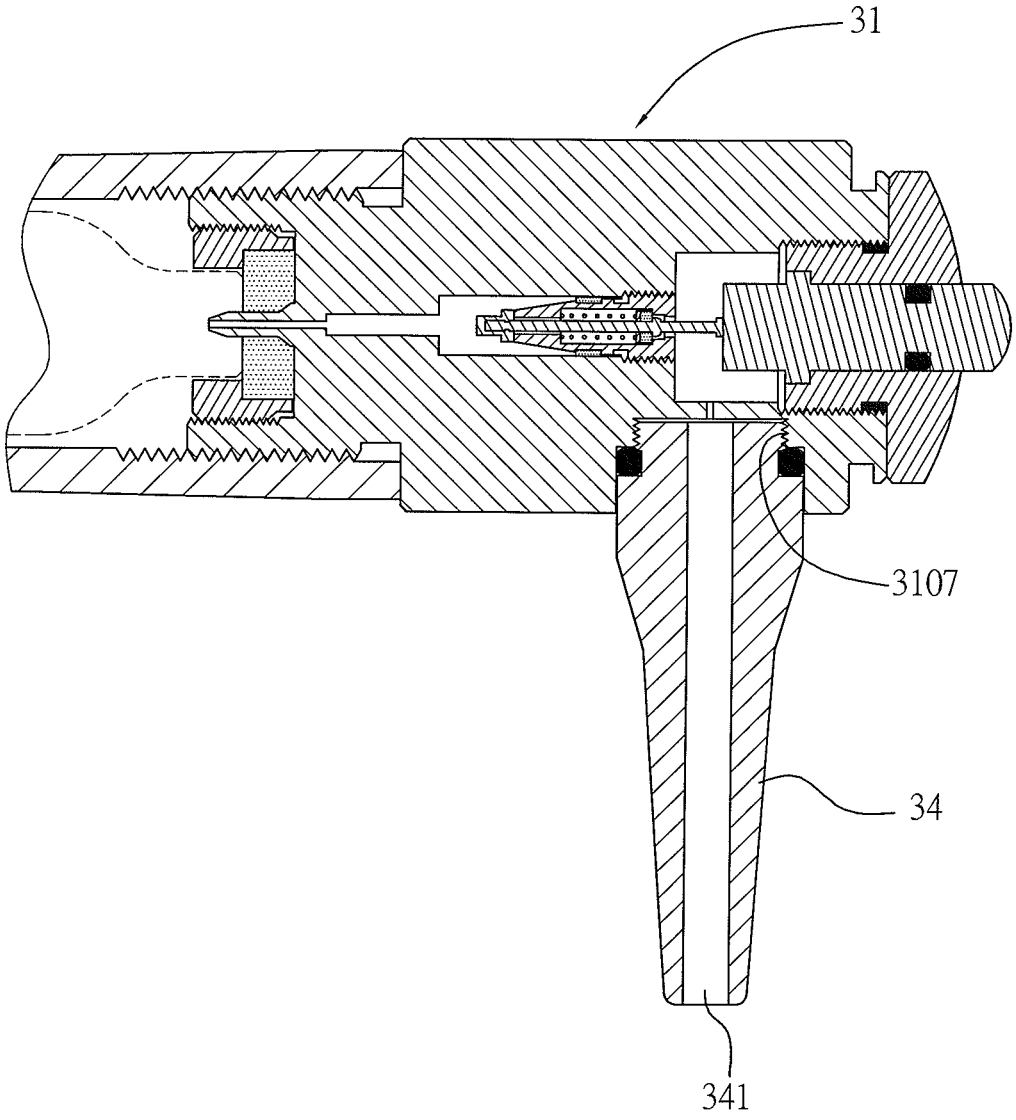
FIG. 12 is a front cross-sectional view of a pneumatically operated opener device in accordance with another preferred embodiment of the present invention.
Figure 13:
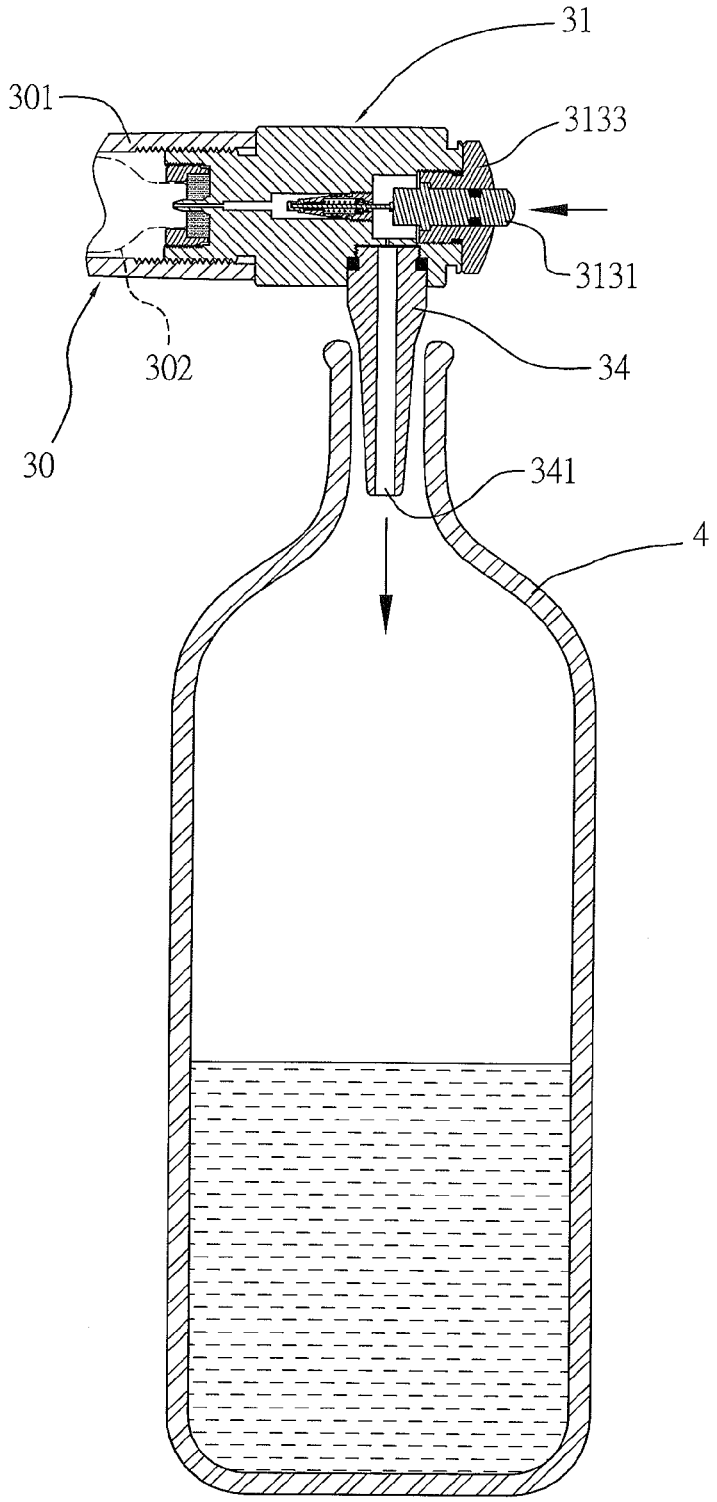
FIG. 13 is a schematic operational view of the pneumatically operated opener device as shown in FIG. 12 in use.
Figure 14:
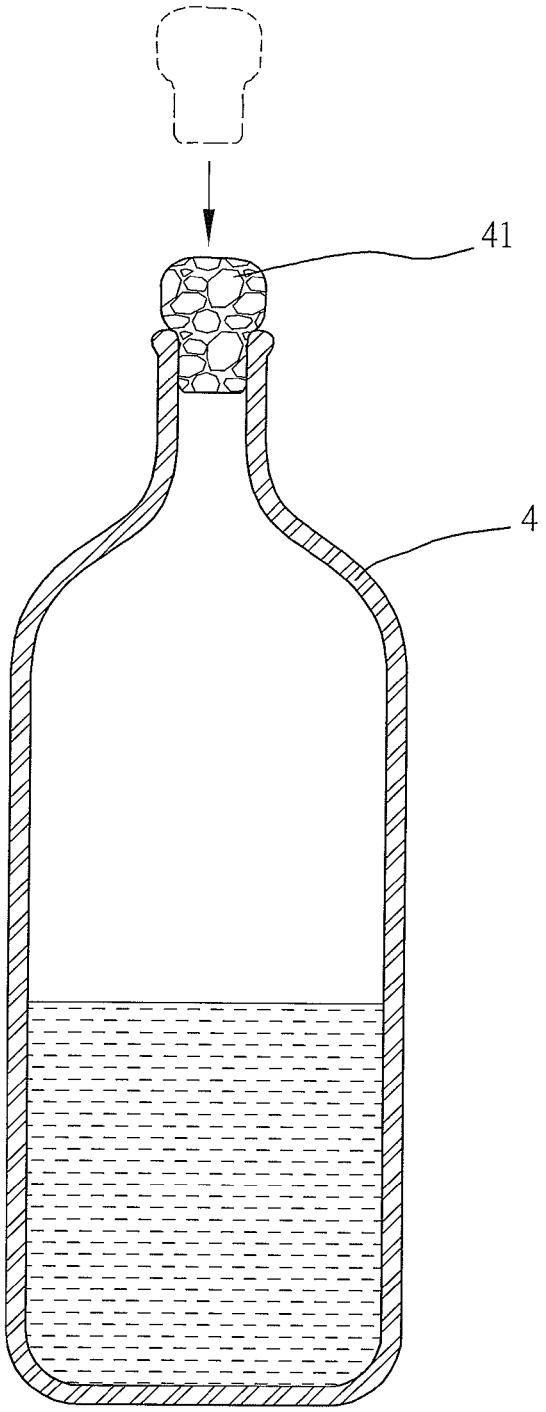
FIG. 14 is a schematic operational view of the pneumatically operated opener device as shown in FIG. 13.

Referring to FIGS. 12-14, the pneumatically operated opener device further comprises a gas injection tube 34 connected with the valve seat 310 of the air valve unit 31. The gas injection tube 34 has a conical shape and has a first end provided with a gas injection hole 341 and a second end provided with an outer thread screwed into the threaded groove 3107 of the valve seat 310. The gas injection tube 34 is inserted into the wine bottle 4. Then, the thrust rod 3131 is pressed inward by the user, to drive the air inlet nozzle 3130 which is moved to press the air outlet terminal of the high pressure nitrogen bottle 302 so as to open the high pressure nitrogen bottle 302 so that the nitrogen in the high pressure nitrogen bottle 302 is released and in turn flows through the air inlet nozzle 3130 and the gas injection hole 341 of the gas injection tube 34 into the wine bottle 4 as shown in FIG. 13. Then, the cork 41 is mounted on the wine bottle 4 as shown in FIG. 14. In such a manner, the nitrogen isolates and prevents the liquid in the wine bottle 4 from touching oxygen in the air to provide an anti-oxidation effect so as to enhance the conservation period of the wine.

Figure 15:
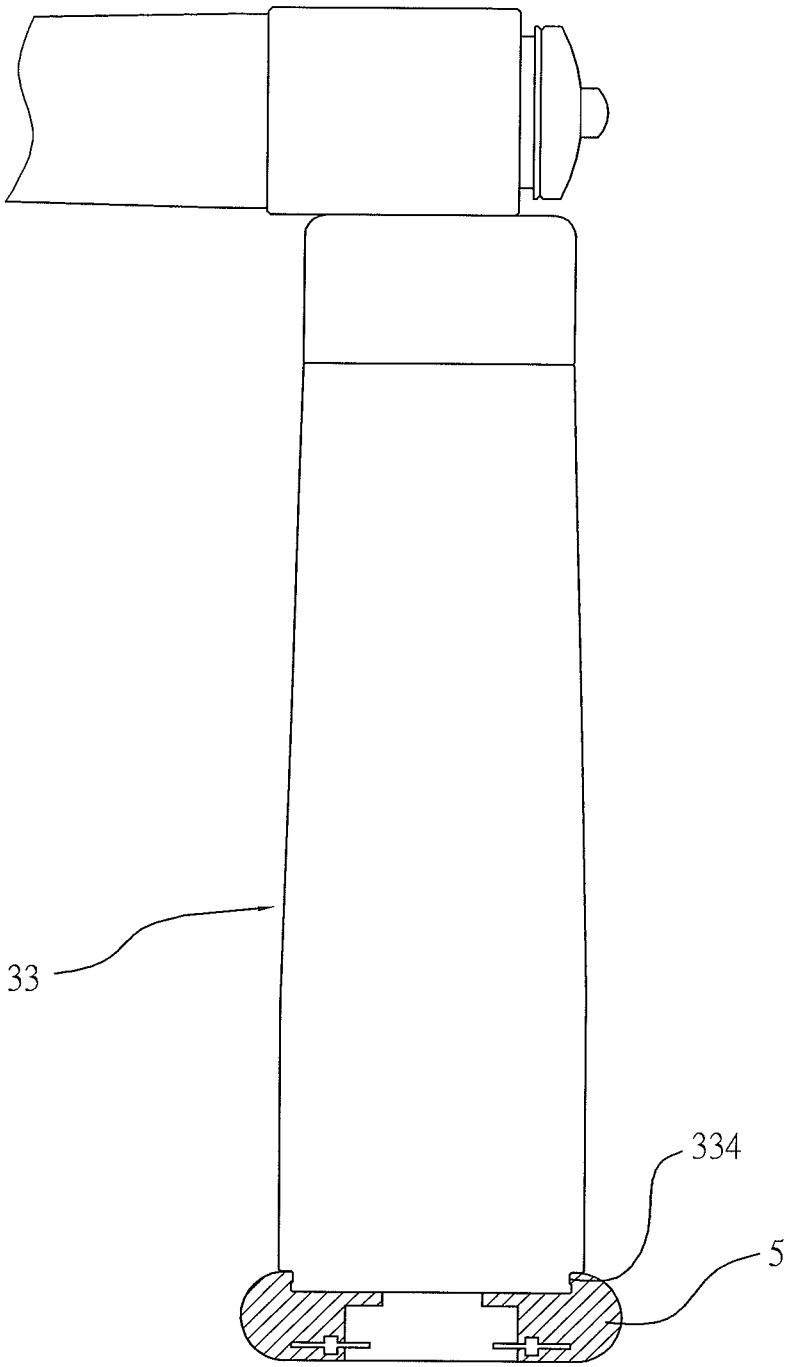
FIG. 15 is a partially front cross-sectional view of a pneumatically operated opener device in accordance with another preferred embodiment of the present invention.

Referring to FIG. 15, the mounting member 33 has an outer edge provided with a groove 334 for mounting an opener 5 to prevent the opener 5 from being lost.

Figure 16:
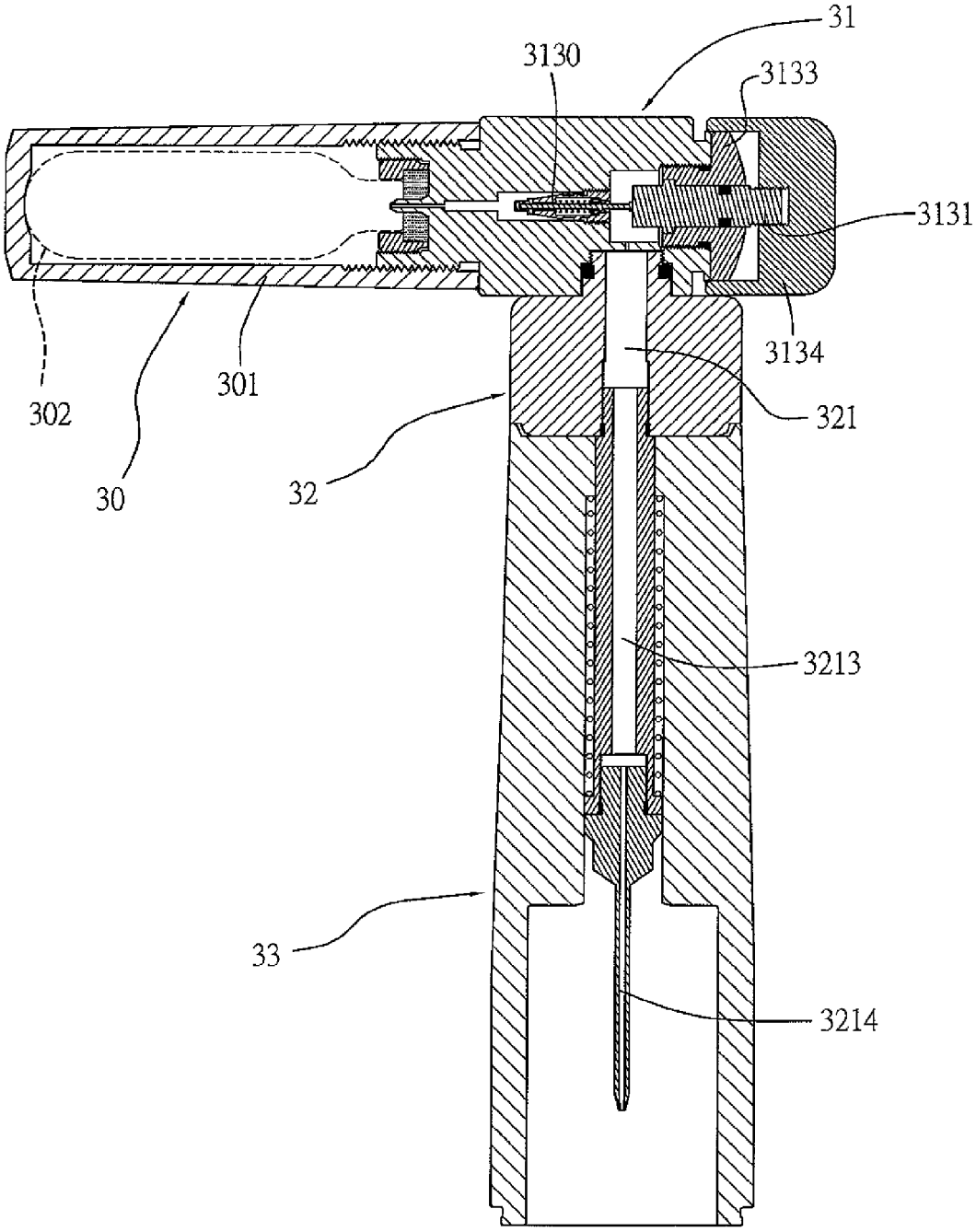
FIG. 16 is a front cross-sectional view of a pneumatically operated opener device in accordance with another preferred embodiment of the present invention.

Referring to FIG. 16, a cap 3134 is screwed onto the thrust rod 3131 and mounted on the knob 3133 to cover the thrust rod 3131 and the knob 3133.

Accordingly, the cork 41 is pushed upward by the thrust force of the nitrogen from the high pressure nitrogen bottle 302 and is detached from the wine bottle 4 smoothly so that the cork 41 will not be deformed or broken and will not produce chips during the opening process to prevent the chips from falling into the wine bottle 4. In addition, the air injecting needle 3214 is received in the hollow slot 333 of the mounting member 33 when not in use to prevent the air injecting needle 3214 from injuring or hurting the user unintentionally. Further, the nitrogen isolates and prevents the liquid in the wine bottle 4 from touching oxygen in the air so as to enhance the storage life of the wine.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A pneumatically operated opener device comprising:

a holding unit, an air valve unit, an air injection unit, and a mounting member; wherein:

the holding unit includes a hollow grip and a high pressure nitrogen bottle mounted in the hollow grip;

the air valve unit includes a valve seat and a compressed nozzle module mounted on the valve seat;

the air injection unit includes a hollow air duct, a hollow push rod mounted on a lower end of the hollow air duct, and an air injecting needle mounted on a lower end of the hollow push rod;

the mounting member is a cylindrical sleeve;

the mounting member has an interior provided with a through hole;

the hollow push rod of the air injection unit is extended through the through hole of the mounting member and connected with the hollow air duct; and the mounting member has a lower end provided with a hollow slot.

2. The pneumatically operated opener device of claim 1, wherein the high pressure nitrogen bottle is located outside of the hollow grip.

3. The pneumatically operated opener device of claim 1, wherein the mounting member is a triangular cylindrical sleeve, a quadrangular cylindrical sleeve or a polygonal sleeve.

4. The pneumatically operated opener device of claim 1, further comprising a gas injection tube connected with the valve seat of the air valve unit.

* * * * *